US007815011B2

(12) United States Patent
Holzman et al.

(10) Patent No.: US 7,815,011 B2
(45) Date of Patent: Oct. 19, 2010

(54) MOVABLE ACOUSTIC SHELL ASSEMBLY

(75) Inventors: Malcolm Holzman, New York, NY (US); Delia Nevola, White Plains, NY (US); Bradley A. Lukanic, New York, NY (US)

(73) Assignee: Holzman Moss Architecture, LLP, New York, NY (US)

( * ) Notice: Subject to any disclaimer, the term of this patent is extended or adjusted under 35 U.S.C. 154(b) by 132 days.

(21) Appl. No.: 12/143,440

(22) Filed: Jun. 20, 2008

(65) Prior Publication Data

US 2009/0314574 A1 Dec. 24, 2009

(51) Int. Cl.

| | |
|---|---|
| ***E04B 1/99*** | (2006.01) |
| ***E04H 3/24*** | (2006.01) |
| ***E04H 3/26*** | (2006.01) |
| ***E04H 3/28*** | (2006.01) |
| *E04B 1/00* | (2006.01) |
| *E04H 3/00* | (2006.01) |
| *E04H 3/22* | (2006.01) |

(52) U.S. Cl. ..... 181/30; 52/7

(58) Field of Classification Search ..... 181/287, 181/30; 52/6, 7; 212/276, 169, 285, 270
See application file for complete search history.

(56) References Cited

U.S. PATENT DOCUMENTS

| | | | | | |
|---|---|---|---|---|---|
| 631,843 | A | * | 8/1899 | Apthorp | 181/30 |
| 721,767 | A | * | 3/1903 | Wood | 52/7 |
| 1,238,228 | A | * | 8/1917 | Weil | 52/67 |
| 1,491,951 | A | * | 4/1924 | Hasait | 52/7 |
| 1,675,102 | A | * | 6/1928 | Holland | 181/30 |
| 3,232,370 | A | * | 2/1966 | Jaffe | 181/30 |
| 3,244,291 | A | * | 4/1966 | Dexter | 414/591 |
| 3,302,801 | A | * | 2/1967 | Poroli | 212/176 |
| 3,383,810 | A | * | 5/1968 | Mola | 52/7 |
| 3,399,887 | A | * | 9/1968 | Altier | 472/75 |
| 3,435,909 | A | * | 4/1969 | Urch et al. | 181/30 |
| 3,469,354 | A | * | 9/1969 | Meetze, Jr. | 52/1 |
| 3,630,309 | A | * | 12/1971 | Wenger et al. | 181/30 |
| 3,866,712 | A | * | 2/1975 | Carruthers | 181/178 |
| 4,278,145 | A | * | 7/1981 | Eade et al. | 181/30 |
| 4,290,332 | A | * | 9/1981 | Schoeffling, Jr. | 84/723 |
| 4,381,839 | A | * | 5/1983 | Engler et al. | 212/314 |
| 4,573,853 | A | * | 3/1986 | Lorenz | 414/460 |
| 4,720,945 | A | * | 1/1988 | Berranger et al. | 52/7 |
| 5,168,129 | A | * | 12/1992 | D'Antonio | 181/30 |
| 5,323,564 | A | * | 6/1994 | Mensching et al. | 52/7 |
| 5,327,698 | A | * | 7/1994 | Uhl | 52/68 |
| 5,343,739 | A | * | 9/1994 | Curry | 212/280 |
| 5,400,551 | A | * | 3/1995 | Uhl | 52/68 |
| 5,403,979 | A | * | 4/1995 | Rogers et al. | 181/30 |
| 5,428,344 | A | * | 6/1995 | Curry et al. | 340/539.1 |
| 5,525,766 | A | * | 6/1996 | Atcheson et al. | 181/30 |
| 5,530,211 | A | * | 6/1996 | Rogers et al. | 181/30 |
| 5,646,378 | A | * | 7/1997 | Van Haaff et al. | 181/30 |
| 5,651,405 | A | * | 7/1997 | Boeddeker et al. | 160/135 |

(Continued)

*Primary Examiner*—Edgardo San Martin
(74) *Attorney, Agent, or Firm*—Morrison & Foerster LLP

(57) ABSTRACT

A movable acoustic shell assembly comprises a ground-supported crane and an acoustic shell mounted on the ground-supported crane. The crane is configured to move in a self-propelled and self-directed manner between a storage position and an in-use position within a performing arts venue. When the crane is in the in-use position, the sound shell substantially encloses a rear portion of a stage within the performing arts venue.

13 Claims, 9 Drawing Sheets

U.S. PATENT DOCUMENTS 5,890,323 A * 4/1999 Errato ..... 52/6
5,893,471 A * 4/1999 Zakula ..... 212/345
5,920,476 A * 7/1999 Hennessey et al. ..... 700/17
5,927,022 A * 7/1999 Hirakawa et al. ..... 52/6
6,057,777 A * 5/2000 Dunne et al. ..... 340/686.1
6,081,292 A * 6/2000 Lanigan et al. ..... 348/61
6,085,861 A * 7/2000 Jines ..... 181/30
6,253,494 B1 * 7/2001 Shaffron ..... 52/7
6,431,312 B1 * 8/2002 D'Antonio ..... 181/295
7,258,196 B2 * 8/2007 Radatus et al. ..... 181/224
7,581,619 B1 * 9/2009 Storm ..... 181/225
2005/0246966 A1 * 11/2005 Brown ..... 52/7
2009/0126281 A1 * 5/2009 Santini ..... 52/7
2009/0127048 A1 * 5/2009 Ichimura ..... 191/33 R

* cited by examiner

MOVABLE ACOUSTIC SHELL ASSEMBLY

BACKGROUND

1. Field

Embodiments of the claimed subject matter relate generally to acoustic shell assemblies adapted for use in performing arts venues. More particularly, embodiments relate to acoustic shell assemblies capable of efficiently moving between a storage position and an in-use position within a performing arts venue.

2. Discussion of Related Art

Acoustic shells are physical structures designed to capture sound produced in a performance area of a performing arts venue and to project the sound into an audience area of the venue. Acoustic shells can be found in a wide variety of performing arts venues, such as concert halls, theater houses, and outdoor stages, to name but a few.

Acoustic shells can have a variety of different forms and features. For instance, they can be formed of a variety of different materials, such as wood, plaster, metal, gypsum, and fiberglass. Further, they can take on various shapes, such as rectilinear shapes as in a shelled room, or curved shapes as in a shelled semi-dome. Moreover, they can be formed as either permanent fixtures or removable parts of the venues where they are used.

Because many venues are designed to host a variety of different performances, some requiring an acoustic shell and some not, many venues use removable acoustic shells. For instance, large auditorium style venues are commonly used to host both orchestra concerts, which generally require an acoustic shell, and theatrical productions, which generally do not. Accordingly, auditorium style venues typically provide removable acoustic shells to facilitate both types of performances.

Removable acoustic shells are conventionally formed by combining a collection of independent components within the stage area of a performing arts venue. For instance, the walls of a conventional removable acoustic shell may be formed by placing a number of panel sections side by side on the stage, while the ceiling of the conventional removable acoustic shell is formed by hanging panel sections from the stage rigging.

Unfortunately, these conventional removable acoustic shells have several shortcomings, including at least the following. First, they generally require a significant amount of time and labor to set up and take down, which can prevent the stage from being usefully employed for rehearsals or additional performances and will cost the operations a substantial amount of money. Second, they tend to lack aesthetic appeal because they are generally not designed to match the visual appearance of the venue where they are used. Third, because they are formed with transportability in mind, they may sacrifice superior acoustic properties that could otherwise be achieved by using heavier or differently shaped materials.

SUMMARY

Recognizing the need to improve the way acoustic shells are used in multi-purpose performing arts venues, embodiments described herein provide acoustic shell assemblies in which a ground-supported crane supports a acoustic shell and allows the acoustic shell to be efficiently moved between a storage position and an in-use position within a performing arts venue.

According to one embodiment, a movable acoustic shell assembly comprises a ground-supported crane and an acoustic shell mounted within the ground-supported crane. The crane is configured to move between a storage position and an in-use position within a performing-arts venue having a stage. The acoustic shell is dimensioned to substantially enclose a front portion of the stage when the crane is in the in-use position.

According to another embodiment, a method of positioning a movable acoustic shell assembly comprises receiving an actuation signal to initiate movement of the acoustic shell assembly, and in response to receiving the actuation signal, operating a self-propulsion mechanism associated with the assembly to move the assembly from a storage position to an in-use position within a stage area, wherein when the acoustic shell assembly is in the in-use position, an acoustic shell of the assembly substantially encloses a front portion of the stage area.

According to still another embodiment, a method of positioning a movable acoustic shell assembly comprises operating a movement apparatus to generate a force for moving the assembly from a storage position to an in-use position within a stage area, wherein when the acoustic shell assembly is in the in-use position, an acoustic shell of the assembly substantially encloses a front portion of the stage.

DETAILED DESCRIPTION

Selected embodiments are described below with reference to the accompanying drawings. These embodiments are provided as teaching examples and should not be construed to limit the scope of the claims.

Figure 1A:
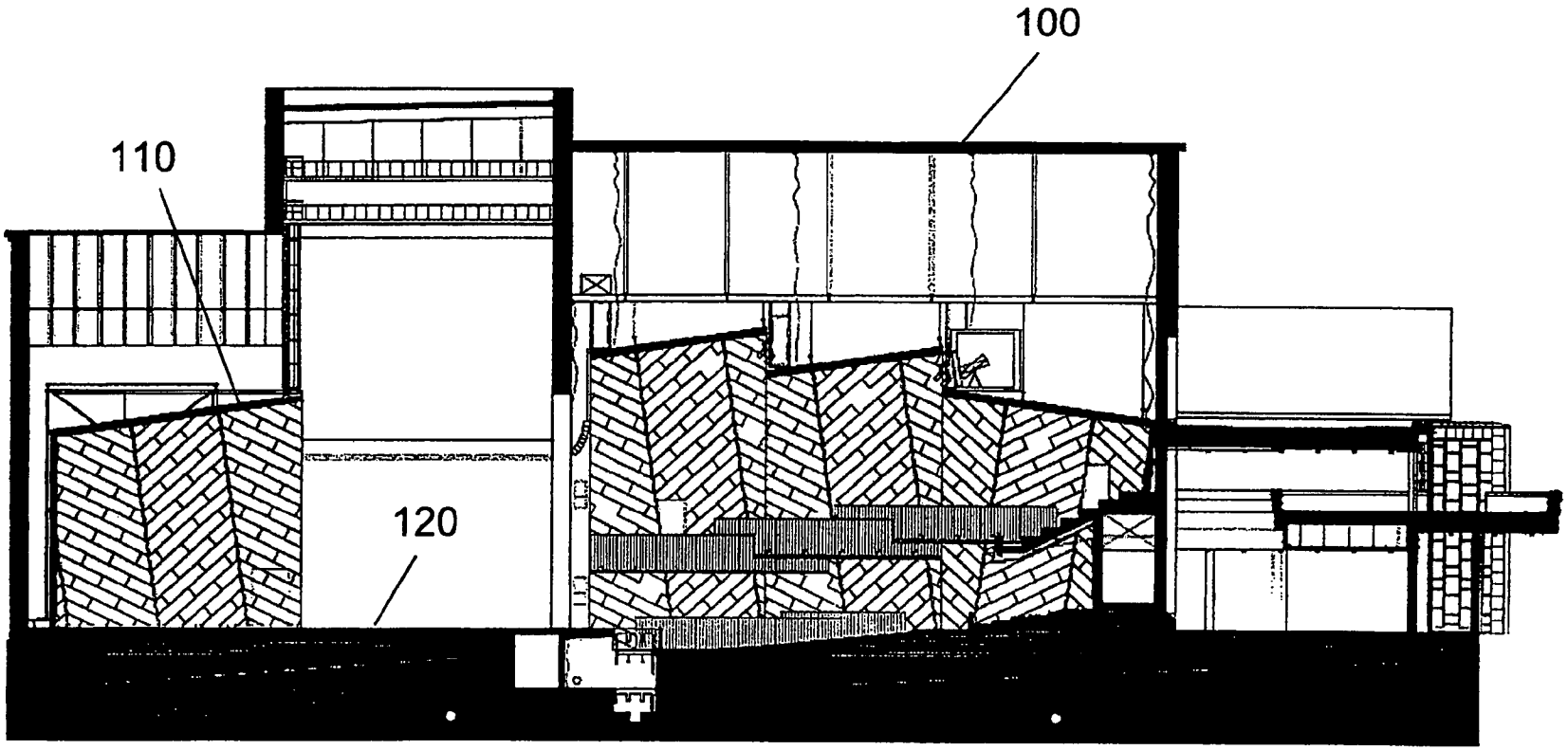
FIGS. 1A and 1B illustrate a movable acoustic shell assembly in a storage position and an in-use position, respectively.
Figure 1B:
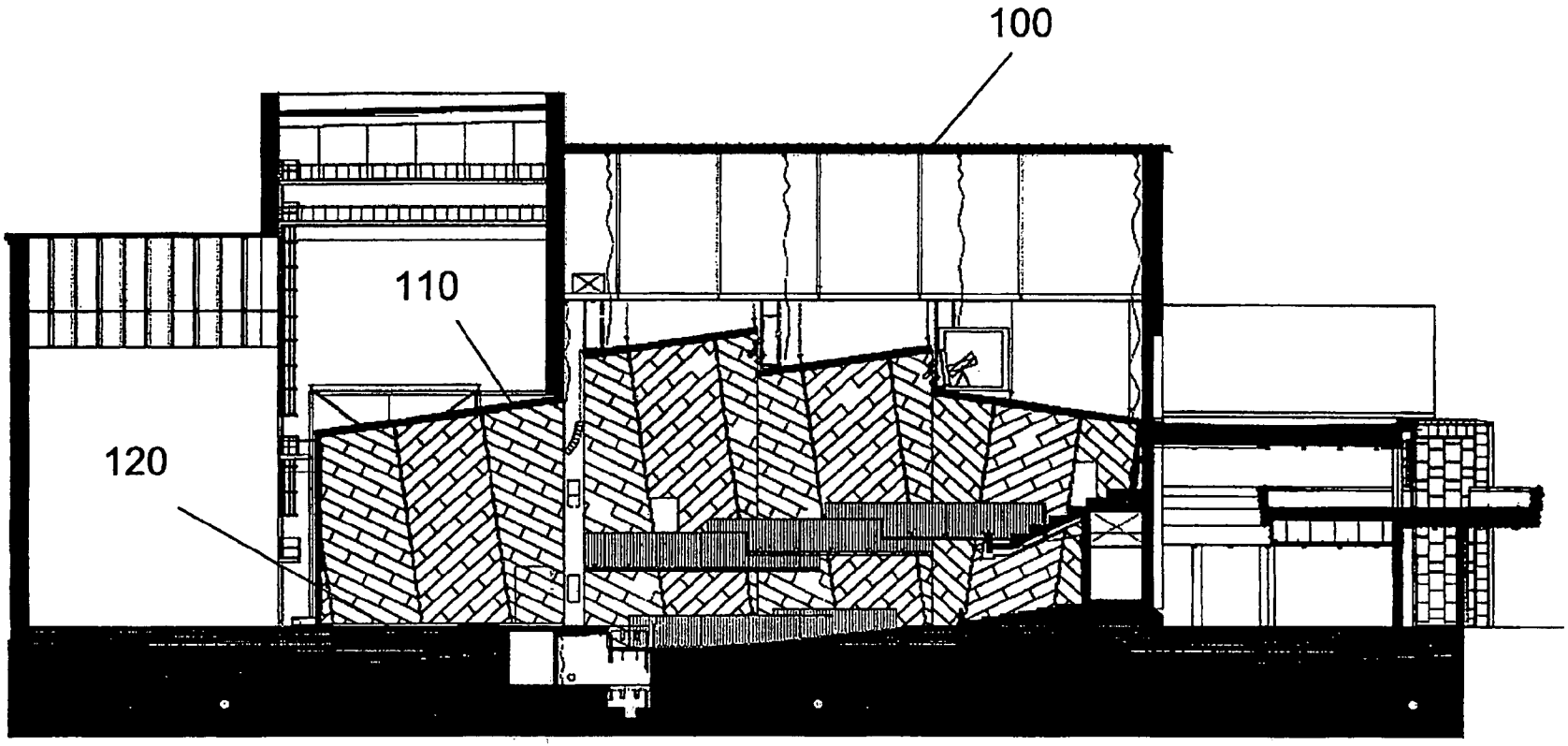

In general, the embodiments relate to movable acoustic shell assemblies adapted for use in performing arts venues. As an example, FIGS. 1A and 1B illustrate a movable acoustic shell assembly 110 within a large auditorium-style performing arts venue 100. FIG. 1A shows acoustic shell assembly 110 in a storage position behind a stage area 120 of auditorium 100; FIG. 1B shows acoustic shell assembly 110 in an in-use position surrounding a portion of stage area 120.

In the example of FIGS. 1A and 1B, the storage position is located directly behind stage area 120 so that acoustic shell assembly 110 can be efficiently moved between the storage position and the in-use position by simple backward and forward movement. When in the in-use position, acoustic shell assembly 110 substantially encloses a front portion of stage area 120 in order to capture and project sound produced by performers within stage area 120. When in the storage position, acoustic shell assembly 110 resides away from stage area 120 so that stage area 120 can be used for purposes that do not require sound capture or projection.

Live concerts are one type of performance that may benefit from the use of an acoustic shell assembly. On the other hand, drama presentations—especially those with large movable sets—are one type of performance that may not require or benefit from an acoustic shell assembly.

In addition to providing acoustic benefits, a movable acoustic shell assembly such as assembly 110 may also add visual aesthetics to a performing arts venue. For instance, in the example of FIGS. 1A and 1B, acoustic shell assembly 110 has a visible design pattern consistent with the house of performing arts venue 100. The design pattern allows acoustic shell assembly 110 to blend in with the rest of performing arts venue 100.

Figure 2A:
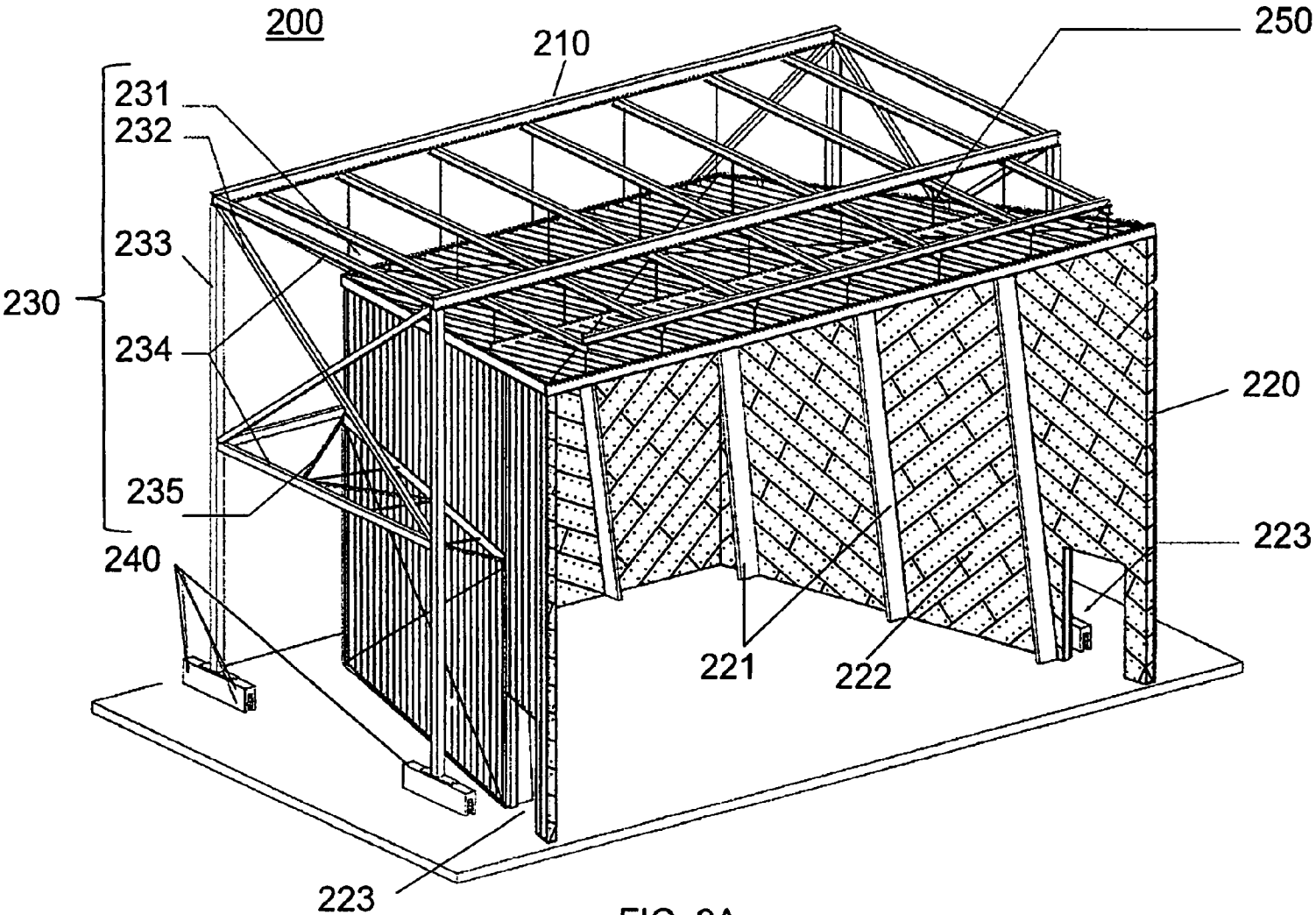
FIGS. 2A and 2B illustrate respective front and back views of a movable acoustic shell assembly in accordance with an embodiment.
Figure 2B:
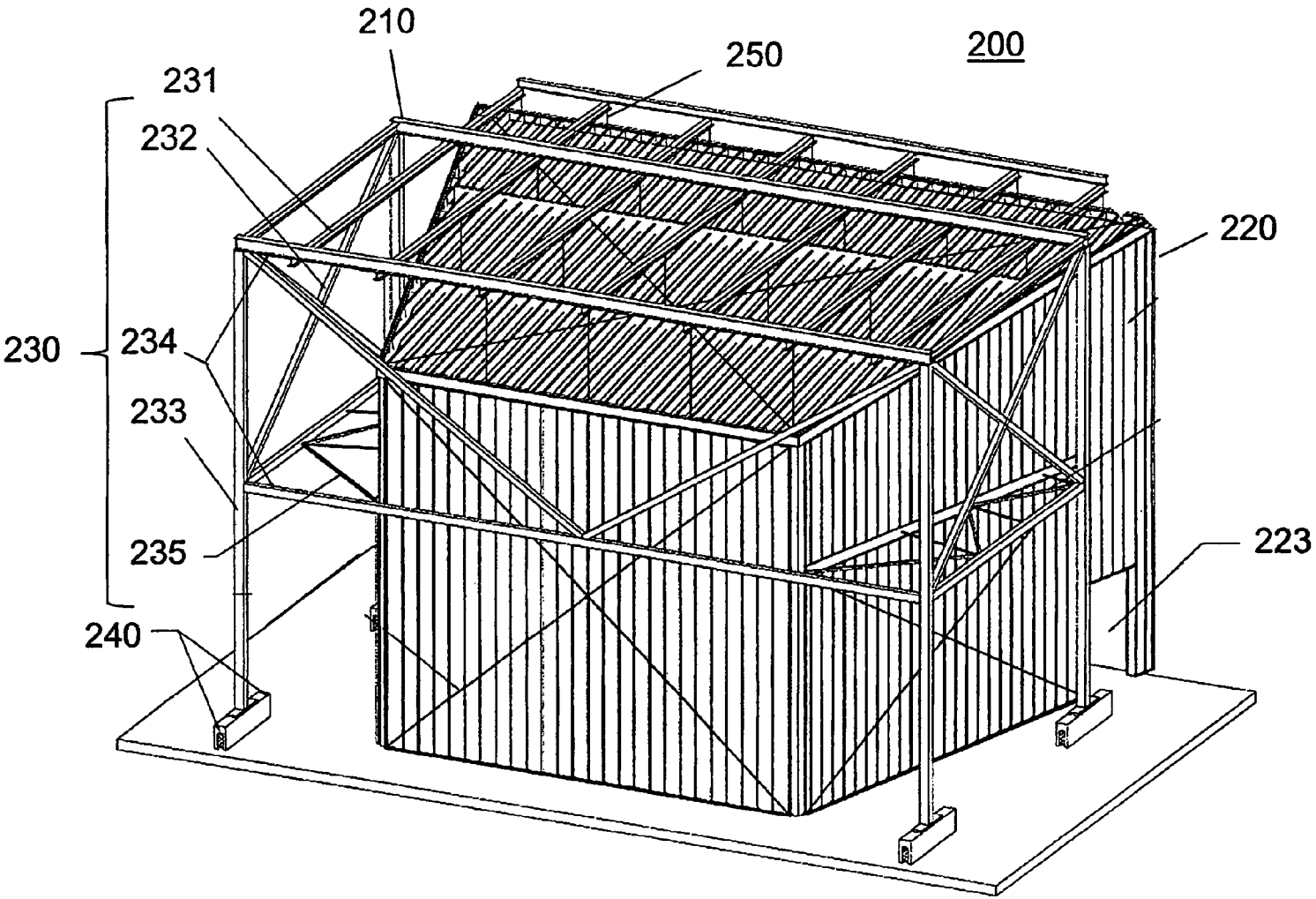

FIGS. 2A and 2B present a more detailed illustration of a movable acoustic shell assembly in accordance with an embodiment. In particular, FIG. 2A shows a front view of an acoustic shell assembly 200, and FIG. 2B shows a back view of acoustic shell assembly 200.

Referring to FIGS. 2A and 2B, acoustic shell assembly 200 comprises a gantry crane 210 and an acoustic shell 220 mounted within gantry crane 210. Gantry crane 210 comprises a support structure 230 for supporting acoustic shell 220, and a movement apparatus 240 for facilitating movement of acoustic shell 220. Acoustic shell 220 comprises a frame 221 for providing structural strength and a reflective surface 222 for providing sound capture and projection.

Within gantry crane 210, support structure 230 comprises a plurality of vertical and horizontal support members 233 and 234 for supporting at least some of the weight of acoustic shell 220, a plurality of cross bracing members 232 for stabilizing support members 233 and 234, structural bracing members 235 for bracing the sides of acoustic shell 220, and structural beam support framing members 231 for distributing the weight of acoustic shell 220 in a substantially even manner across support structure 230. Movement apparatus 240 comprises multiple sets of wheels, where each set is located within a corresponding mounting case beneath one of vertical support members 233. These wheels typically roll across a floor or designated track within a performing arts venue to move acoustic shell assembly 200 between a storage position and an in-use position.

Acoustic shell 220 is suspended from gantry crane 210 by a plurality of aircraft cable supports 250. Aircraft cable supports 250 are attached between portions of structural beam support framing members 231, and portions of frame 221. In this configuration, there may be space between the bottom of acoustic shell 220 and the ground. This space may allow acoustic shell assembly 200 to be moved without producing friction between acoustic shell 220 and the ground.

The design of acoustic shell assembly 200 can be modified in any of several different ways to produce alternative embodiments. For instance, assembly 200 can be modified to change the form and composition of gantry crane 210 or acoustic shell 220; it can be modified to change the structure connecting acoustic shell 220 to gantry crane 210 and the techniques used to move gantry crane 210 along the ground; assembly 200 can be further modified to include supplemental features such as sensors for automatically detecting and responding to obstacles in its pathway, or sensors for detecting its position and movement direction. To illustrate some of these possible modifications, the following paragraphs present specific examples of many such modifications.

Gantry crane 210 can be modified to include fewer or more wheels compared with the embodiment of FIGS. 2A and 2B. For instance, in one alternative embodiment, a modified gantry crane includes additional vertical support members each having an additional set of wheels at its base. The additional support members and wheels can help to distribute the weight of the crane and its dead load across different parts of the ground. This can be useful, for example, to prevent too much weight from being concentrated in small areas of a stage floor surrounding the wheels.

Gantry crane 210 can also be modified to move by means other than wheels. For instance, gantry crane 210 can be supported on pinion gears and made to move along a gear rack, or on a moving chain or belt. Moreover, gantry crane 210 may move by various different propulsion mechanisms, which can include either self-propulsion mechanisms, non self-propulsion mechanisms, or a combination of the two. Example self-propulsion mechanisms include various types of motors attached to one or more wheels at the base of gantry crane 210. Example non self-propulsion mechanisms include the aforementioned moving chains or belts, or other mechanisms by which a stationary component acts to push or pull gantry crane 210.

Gantry crane 210 can be modified to move along a track when passing between the storage position and the in-use position. The track may be formed in various ways, such as by a recess in the floor or by parallel guide structures raised above the ground. In general, it is beneficial to limit such tracks to non-performance areas of a performing arts venue to prevent performers or props from being damaged or distracted by the track (e.g., by tripping and falling).

Gantry track 210 may also include sensors for detecting obstacles or obstructions in the pathway of assembly 200, for guiding the movement of assembly 200, and for determining whether assembly 200 is in a known safe position. Upon making these detections, the sensors may generate and transmit signals to trigger a change in the movement of assembly 200, such as causing assembly to change direction or stop moving altogether.

The sensors for detecting obstacles can be implemented by any of several conventional technologies, such as infrared laser sensors, touch sensors, and beam interrupt sensors, to name but a few. Upon detecting an obstacle or obstruction, these sensors may generate and transmit a signal configured to alter the movement of assembly 200, such as a halt signal for triggering the halting of assembly 200.

The sensors for guiding the movement of assembly 200 may include, for example, laser guide sensors projecting light onto a target object such as a distant mirror, and then detecting properties of the resulting reflected light such as the reflected light's intensity, focus, or direction. Based on the detected properties of the reflected light, the laser guide sensors may determine whether assembly 200 is moving in a desired direction. Upon determining that assembly 200 is not moving in the desired direction, these sensors may generate and transmit signals configured to trigger an alteration of the assembly's movement direction. Accordingly, by relying on these sensors, assembly 200 may move in a self-directed manner.

In some performing arts venues, the target objects for the movement direction sensors may be placed at the front of the stage to safely guide assembly 200 toward its in-use position. In such cases, these sensors may also be used to determine whether assembly 200 is in a known safe position. For instance, as long as these sensors are able to detect light reflected off of the target objects, these sensors may determine that assembly 200 has not reached the front of the stage and is therefore not in danger of tumbling off the stage into the audience. In other words, the sensors may determine that assembly 200 is in a known safe position. On the other hand, if these sensors are unable to detect any reflected light, they may determine that assembly 200 is no longer in a known safe position. Upon determining that assembly 200 is not in a known safe position, the sensors may generate a signal configured to trigger a stopping of the assembly's movement.

In order to interpret and respond to the various signals generated by the above sensors, assembly 200 (or related external components) may include electronic equipment for receiving the signals and controlling various propulsion or steering components to modify the movement of assembly 200. Additionally, assembly 200 or related external components may include electronic equipment for receiving and processing inputs from wireless transmitters such as remote controls. In other words, assembly 200 may also be controlled to move, stop moving, or adjust its movement direction based on inputs from wireless sources such as remote controls.

Acoustic shell 220 can be modified to have different shapes or different compositions. In FIGS. 2A and 2B, acoustic shell 220 has a shape in the form of a shelled room. In other words, its shape is like a room that includes three walls and a ceiling. The walls and ceiling of the shelled room are formed by wood planks supported by a metal frame structure. In alternative embodiments, acoustic shell 220 can be formed with a more curved shape such as a partial dome, or with other materials, such as plaster, gypsum, fiberglass, and so on.

The connections between acoustic shell 220 and gantry crane 210 can be changed to include additional or different components from the aircraft cable supports 250 shown in FIGS. 2A and 2B. For instance, acoustic shell 220 could be suspended from gantry crane 210 by flexible cables or it could be riveted at various fixed points to gantry crane 210. Moreover, although most of the aircraft cable supports 250 in FIGS. 2A and 2B are arranged to form vertical connections between gantry crane 210 and acoustic shell 220, these supports (or other alternative connectors) could be arranged in different configurations such as cross-connected formations in order to prevent acoustic shell 220 from moving relative to gantry crane 210 (e.g., by swinging).

Many of the foregoing variations and modifications of acoustic shell assembly 200 can be implemented in combination with each other or in combination with other features presented in this written description. Accordingly, the described variations and modifications demonstrate the possibility of embodying the claimed subject matter in a wide variety of alternative forms.

Figure 3:
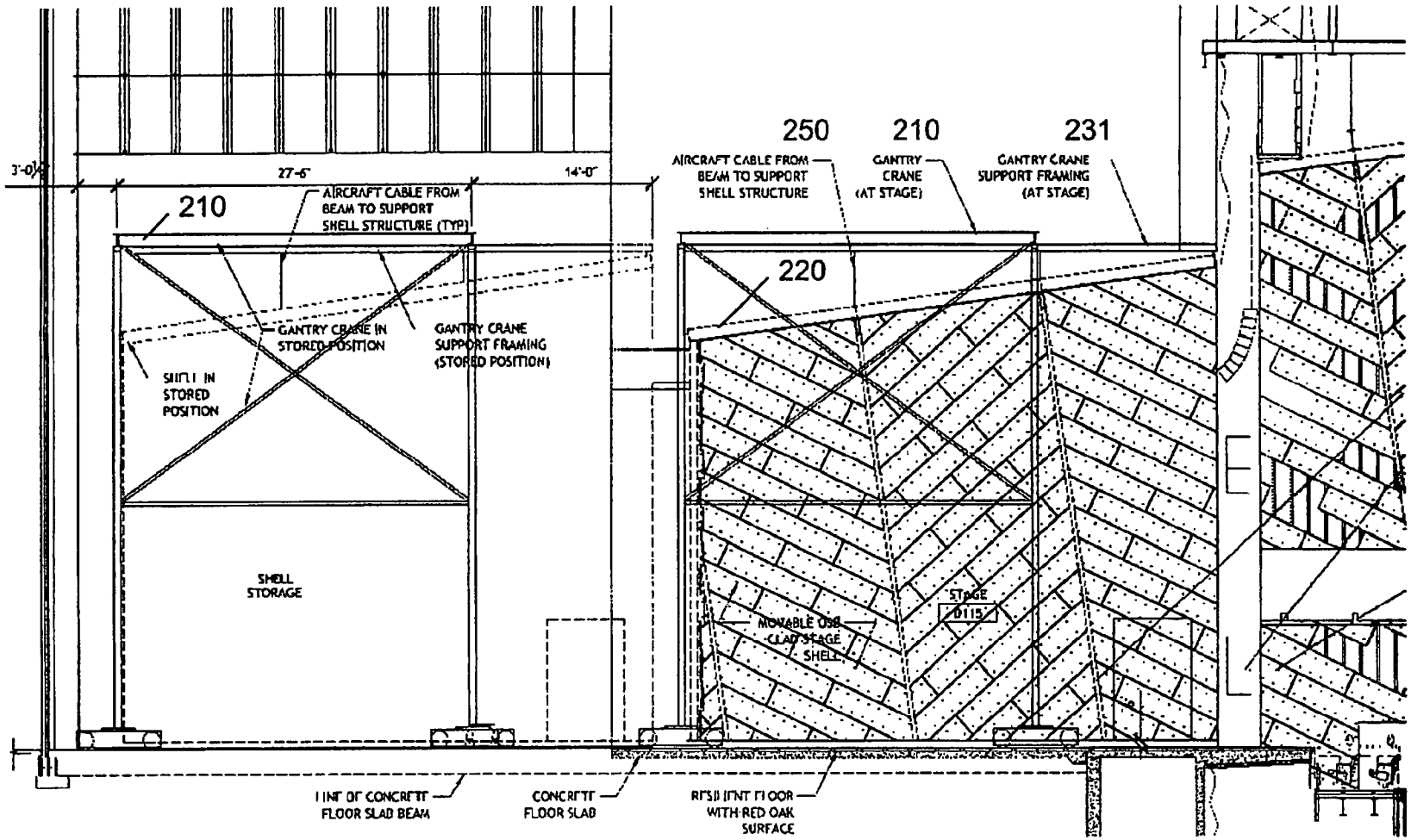
FIG. 3 illustrates a side view of a movable acoustic shell assembly in accordance with an embodiment.
Figure 4:
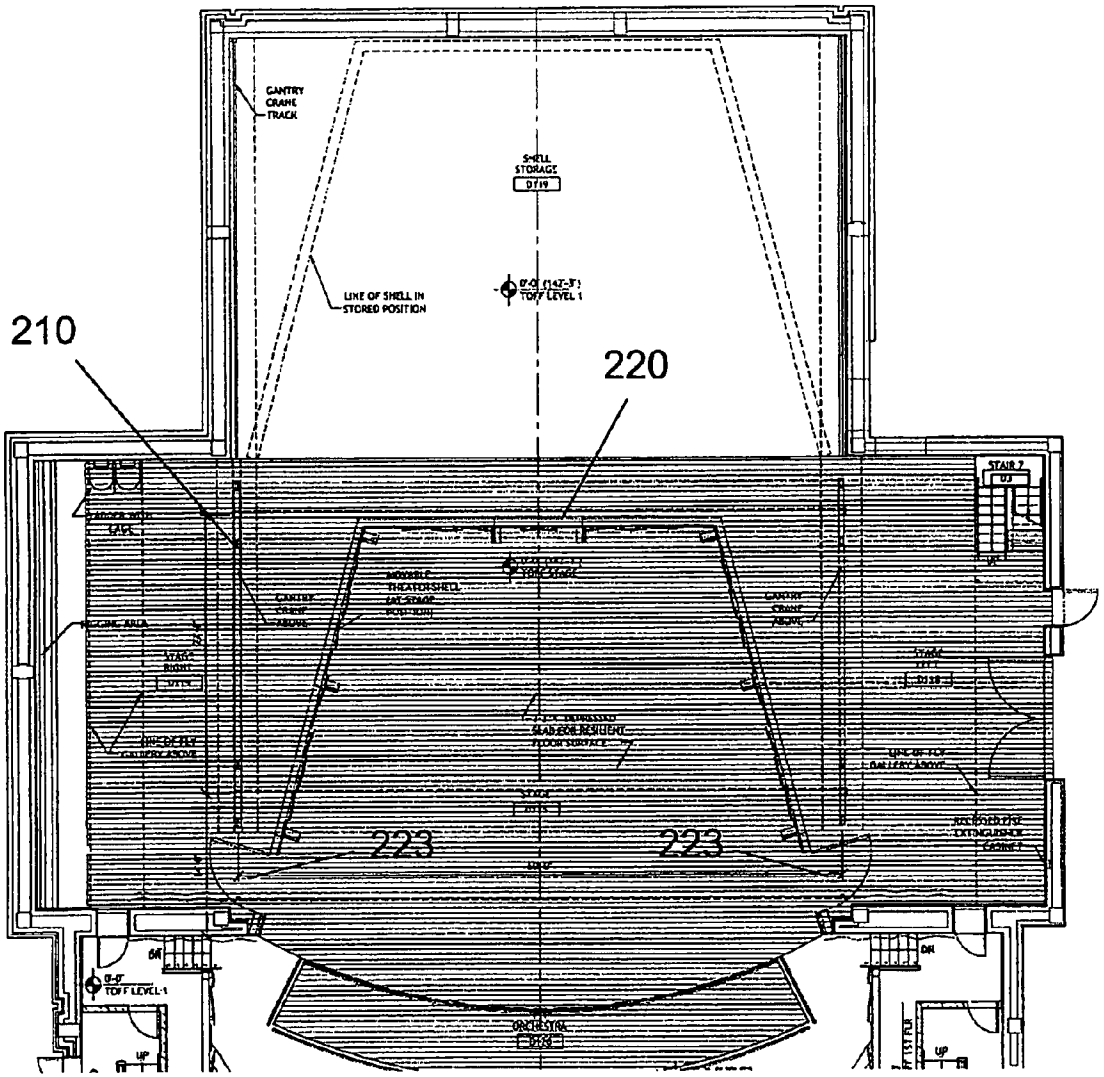
FIG. 4 illustrates a top view of an outer portion of a movable acoustic shell assembly in accordance with an embodiment.
Figure 5:
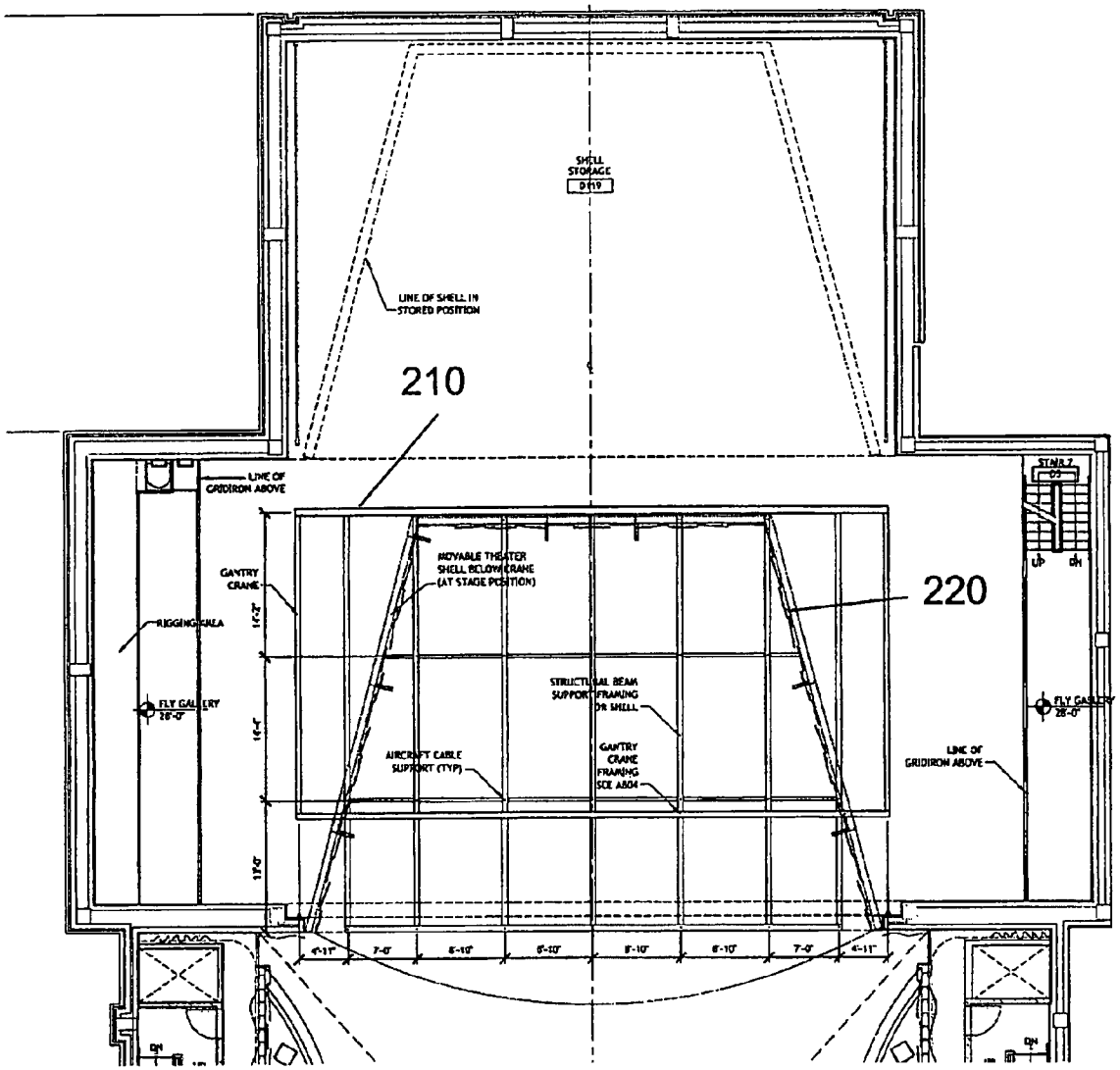
FIG. 5 illustrates a top view of an upper portion of a movable acoustic shell assembly in accordance with an embodiment.

FIGS. 3 through 5 show different views of acoustic shell assembly 200 within an example performing arts venue. In particular, FIG. 3 shows a side view of acoustic shell assembly 200, while FIGS. 4 and 5 show top views of acoustic shell assembly 200.

In FIG. 3, acoustic shell assembly 200 is shown in an in-use position. Additionally, to illustrate the displacement of acoustic shell assembly 200 between the in-use position and the storage position, FIG. 3 also shows a partial outline of acoustic shell assembly 200 in the storage position, with acoustic shell 220 indicated by dotted lines. As illustrated by FIG. 3, acoustic shell assembly 200 can move between the storage position and the in-use position by simple backward and forward motion.

In the example of FIG. 3, the performing arts venue includes concrete beams below both the storage position and the in-use position. These concrete beams are designed to bear the weight of acoustic shell assembly 200, which may weigh many (e.g., 20) tons. Additionally, the beams below the in-use position may prevent assembly 200 from crushing the wooden floor of the venue's stage. Because of the assembly's potentially large weight, many existing performing arts venues may be unable to support such an assembly.

FIG. 4 shows a top view of a lower portion of acoustic shell assembly 200 in the context of a performing arts venue. This view illustrates, among other things, how assembly 200 substantially encloses a front stage portion when in the in-use position. It also illustrates how shell openings 223 are positioned in front of the lower portions of gantry crane 210 to allow performers to safely enter and exit the stage.

FIG. 5 shows a top view of an upper portion of acoustic shell assembly 200 in the context of the performing arts venue shown in FIG. 4. This view illustrates, among other things, the spatial extent of the gantry crane's support structure 230 and how it fits within the performing arts venue.

Figure 6:
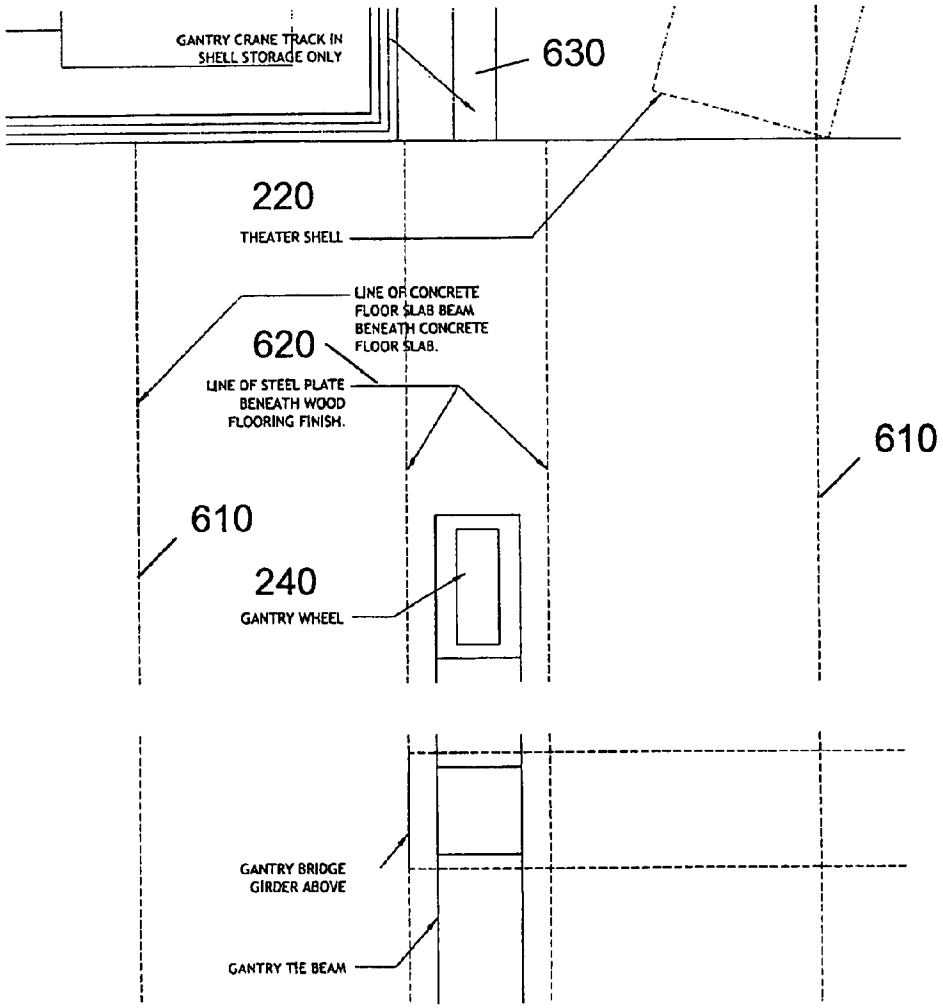
FIG. 6 illustrates a top view of one side of a gantry crane positioned above a floor designed to support an acoustic shell assembly in accordance with an embodiment.

FIG. 6 is a top view illustrating a spatial relationship between one side of acoustic shell assembly 200 and parts of a performing arts venue. Within FIG. 6, a pair of dotted lines 610 illustrate side boundaries of a concrete beam formed below a wood floor in the stage area of the performing arts venue. Another pair of dotted lines 620 illustrate side boundaries of a steel plate formed between the concrete beam and the wood floor. The wheels of gantry crane 220 move along the surface of the wood floor above the steel plate. Accordingly, the steel plate and the concrete beam provide support for acoustic shell assembly 200 and prevent its wheels from crushing or otherwise damaging the wood floor.

FIG. 6 also shows a gantry crane track 630 formed by a recess in the floor where acoustic shell assembly 200 is stored. A line 640 denotes a boundary between a stage area where acoustic shell assembly 200 is placed in its in-use position, and a storage area where acoustic shell assembly 200 is placed in its storage position. Gantry crane track 630 is formed within the storage area but not the stage area in order to prevent the recess from creating a hazard for performers within the stage area.

Figure 7:
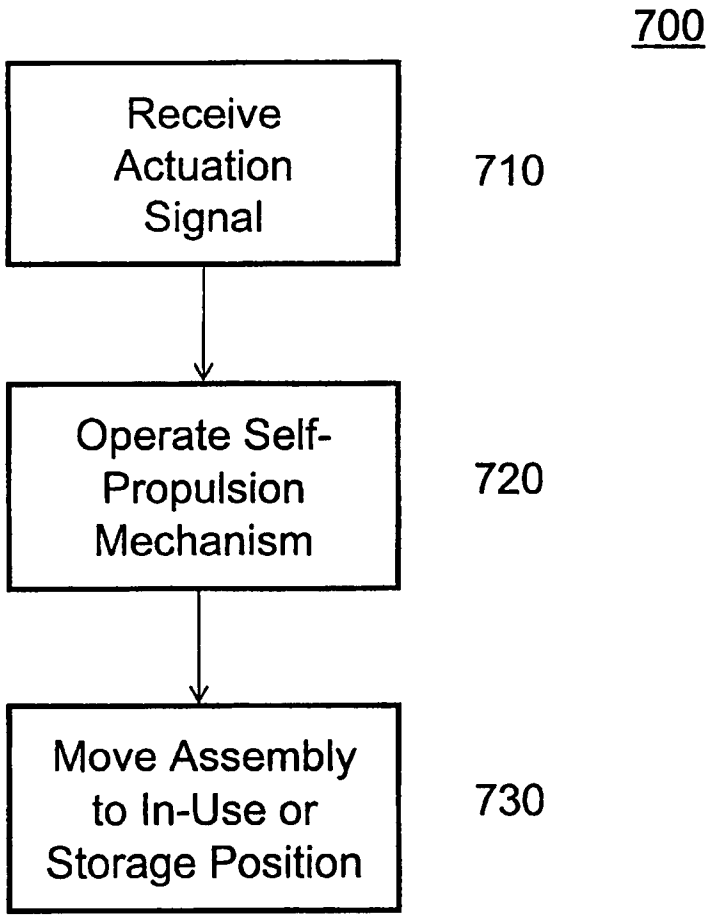
FIG. 7 illustrates a method of positioning a movable acoustic shell assembly in accordance with an embodiment.

FIG. 7 illustrates a method 700 for positioning a movable acoustic shell assembly such as that illustrated in FIGS. 2-5 within a performing arts venue. According to the method, the assembly receives an actuation signal to initiate movement of the assembly (710). The actuation signal may be transmitted to the assembly, for example, from a wireless remote control or a data transmission cable. The assembly may receive the signal, for example, via a wireless receiver operatively connected to a controller designed to control the operation of a movement apparatus such as a motor.

In response to receiving the actuation signal, the assembly operates a motor or some other self-propulsion apparatus to provide a force for moving the assembly (720). As an example, the assembly may operate the motor to turn a set of wheels supporting the assembly. The self-propulsion apparatus, in turn, moves the assembly from a storage position to an in-use position (or vice versa) within the performing arts venue. When in the in-use position, the assembly substantially encloses a front portion of a stage within the venue, as illustrated, for instance, in the example of FIG. 4.

The method of FIG. 7 can be modified in any of several different ways, such as by employing different techniques to move a gantry crane, or modifying the motion of gantry crane based on signals generated by various types of sensors. Many of these possible modifications are discussed above in relation to FIG. 2 and will not be repeated in order to avoid redundancy.

In view of the foregoing, it should be appreciated that selected embodiments may provide significant benefits by comparison with conventional acoustic shell technologies. For instance, selected embodiments allow a large acoustic shell to be quickly deployed and stored with a minimal amount of human intervention. Selected embodiments also provide safety mechanisms for preventing the shell from injuring people or objects within its environment when being moved. Many embodiments can be constructed from existing crane technologies, which may simplify the cost of designing and implementing their movable parts. Moreover, several embodiments include only a small number of moving parts, many of which are located near the ground, making them relatively easy to inspect and maintain.

The invention claimed is:

1. A movable acoustic shell assembly, comprising:

a ground-supported crane comprising a movement apparatus configured to move the ground-supported crane in a self-propelled manner between a storage position and an in-use position within a performing-arts venue having a stage, the movement apparatus being configured to be in contact with the stage; and a unitary acoustic shell dimensioned to substantially enclose a front portion of the stage, the acoustic shell being mounted within the ground-supported crane such that when the ground-supported crane moves from the storage position to the in-use position, the acoustic shell moves with the ground-supported crane to substantially enclose the front portion of the stage.

2. The movable acoustic shell assembly of claim 1, wherein the ground-supported crane moves in a self-directed manner.

3. The movable acoustic shell assembly of claim 1, comprising:

at least one sensor configured to detect the presence of an obstruction in a pathway of the acoustic shell between the storage position and the in-use position.

4. The moveable acoustic shell assembly of claim 3, wherein the at least one sensor is configured to generate, upon detection of an obstruction, a halt signal adapted to trigger a halting of the assembly's movement.

5. The movable acoustic shell assembly of claim 1, comprising:

at least one direction sensor configured to detect a movement direction of the crane relative to a target position and to generate a direction modification signal to trigger an adjustment of the movement direction based on the detection.

6. The movable acoustic shell assembly of claim 1, wherein the acoustic shell has a shape in the form of a shelled room.

7. The movable acoustic shell assembly of claim 1, wherein the movement apparatus comprises multiple wheels actuated by an attached motor to provide a force for moving the crane.

8. The movable acoustic shell assembly of claim 1, wherein the crane incorporates a self-propulsion mechanism capable of being initiated by a wireless remote-control.

9. The movable acoustic shell assembly of claim 1, comprising a safety stop sensor configured to detect whether the crane is in a known safe position, and to generate a stop signal to trigger stopping of the crane's movement upon detecting that the crane is not in a known safe position.

10. The movable acoustic shell assembly of claim 1, wherein the acoustic shell has a visual design pattern consistent with a visual design pattern of a house portion of the performing arts venue.

11. The movable acoustic shell assembly of claim 1, wherein the movement apparatus comprises tracks.

12. The movable acoustic shell assembly of claim 11, wherein the tracks are configured to fit into recesses in the stage.

13. The movable acoustic shell assembly of claim 1, wherein the acoustic shell is mounted within the crane by cables.

* * * * *